US005544606A

United States Patent [19]

Schmidt, Jr.

[11] Patent Number: 5,544,606

[45] Date of Patent: Aug. 13, 1996

[54] BOAT LIFTING DEVICE

[75] Inventor: Anthony Schmidt, Jr., North Fort Myers, Fla.

[73] Assignee: Jack Bradley, Ft. Lauderdale, Fla.; a part interest

[21] Appl. No.: 437,694

[22] Filed: May 9, 1995

[51] Int. Cl.[6] ..... B63C 1/02

[52] U.S. Cl. ..... 114/48; 114/366

[58] Field of Search ..... 114/44–48, 363, 114/366; 440/61; 187/27; 405/3

[56] References Cited

U.S. PATENT DOCUMENTS 2,761,571 9/1956 Adams ..... 114/366

3,421,723 1/1969 Holt ..... 440/61

4,232,627 11/1980 Glenn et al. ..... 440/44

4,878,450 11/1989 Schmidt, Jr. ..... 114/44

*Primary Examiner*—Jesus D. Sotelo

[57] ABSTRACT

A plurality of support vertical extensions are attached to the rear surface or transom of a boat, or to a dock. Each support vertical extension has a horizontal member so that a dinghy or the like can be supported transversely to the boat or dock. The vertical extensions, and thus the horizontal members, are raised and lowered by at least one hydraulic cylinder driving each of the vertical extensions. The vertical extensions are preferably telescoping into fixed vertical support members.

5 Claims, 4 Drawing Sheets

BOAT LIFTING DEVICE

FIELD OF THE INVENTION

The present invention relates to an improved boat lifting device that may be secured to the transom of a larger boat, or to a dock, and used to raise or lower a dinghy therefrom. More specifically, the improvement relates to a boat lifting device whose extensions are rigid and are not susceptible to the wave conditions present in a body of water.

BACKGROUND OF THE INVENTION

In a prior patent issued to the present inventor, U.S. Pat. No. 4,878,450, a boat lifting invention is disclosed and taught for raising, storing and lowering a small water craft, such as a dinghy. In the specification of U.S. Pat. No. 4,878,450, a number of other prior art patents are referred to relative to boat lifting devices. Additionally, the United States patent to Adams, U.S. Pat. No. 2,761,571, describes a marine hoist which uses pistons to bear the weight load for hoisting "stores, personnel and the like." However, these devices do not employ a plurality of telescoping extensions to bear load, such as a dinghy, in such a manner as to provide for a rigid lift when the extensions are lowered into a body of water thus eliminating the wave undulations present in that body of water.

SUMMARY OF THE INVENTION

The invention comprises generally a plurality of support vertical extensions attached to the rear surface or transom of a boat, or to a dock. Each support vertical extension has a horizontal member so that a dinghy or the like can be supported transversely to the boat or dock. The vertical extensions, and thus the horizontal members, are raised and lowered by at least one hydraulic cylinder driving each of the vertical extensions. The vertical extensions are preferably telescoping into fixed vertical support members.

BRIEF DESCRIPTION OF THE DRAWINGS

The features embodying the present invention are illustrated in the accompanying drawing, forming a part of this application, in which.

DETAILED DESCRIPTION OF A PREFERRED EMBODIMENT

Figure 1:
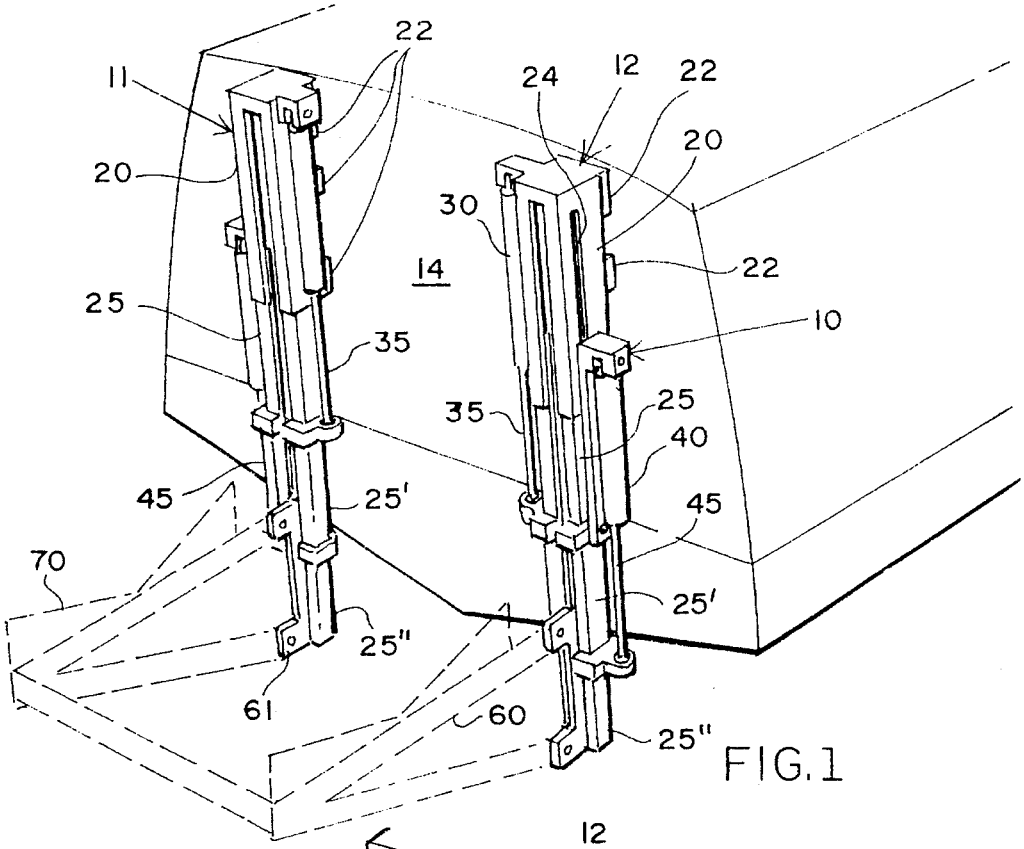
FIG. 1 is a perspective view of the preferred embodiment of the present invention attached to the transom of a boat.
Figure 2:
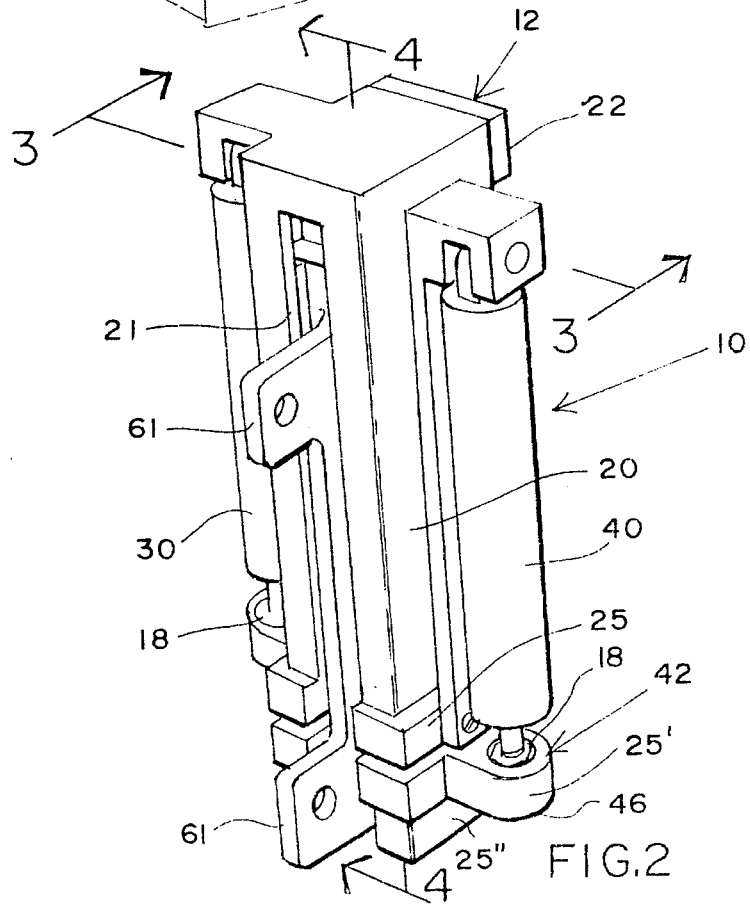
FIG. 2 is a perspective view of the preferred embodiment of the present invention in its retracted state.
Figures 3, 4:
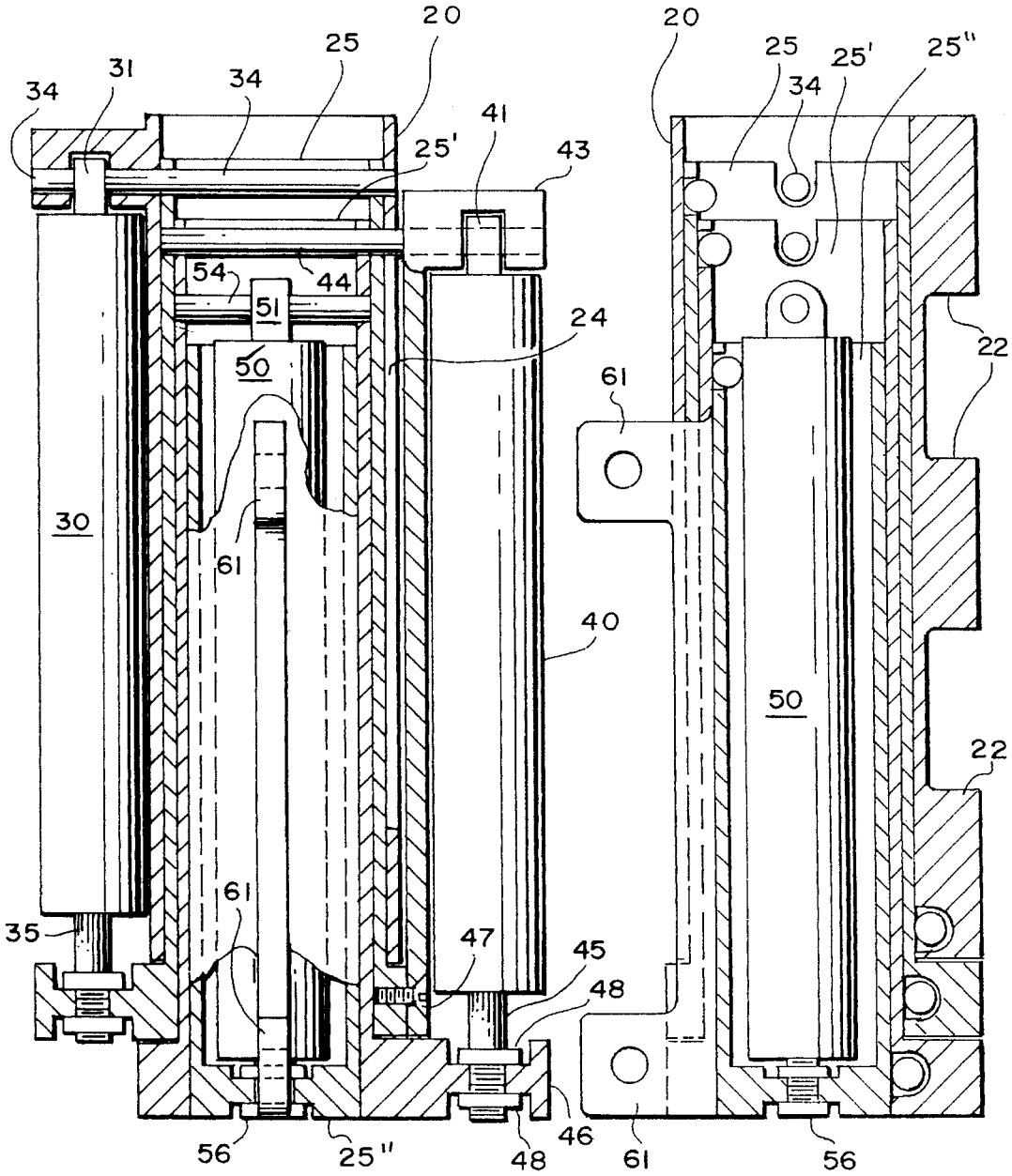
FIG. 3 is a front, cross section view of the preferred embodiment of the present invention in its retracted state.
FIG. 4 is a side, cross section view of the preferred embodiment of the present invention in its retracted state.
Figure 5:
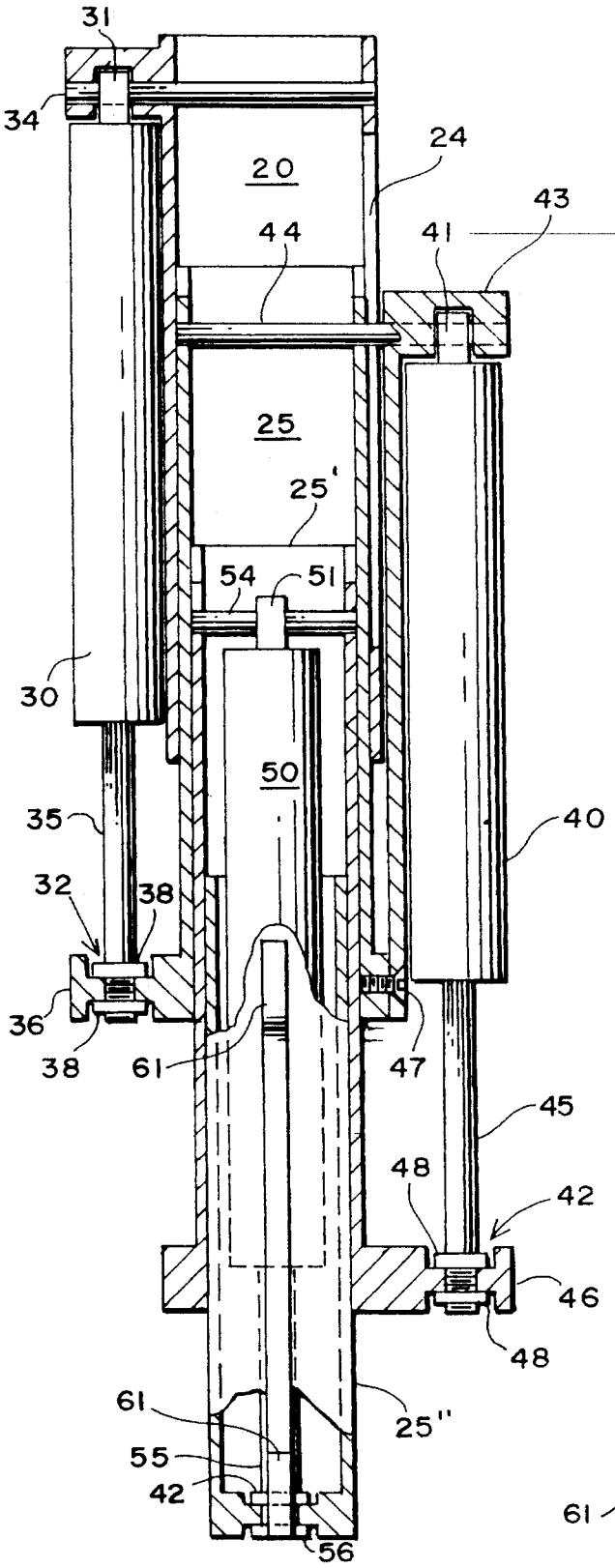
FIG. 5 is a front, cross section view of the preferred embodiment of the present invention in its extended state.
Figure 6:
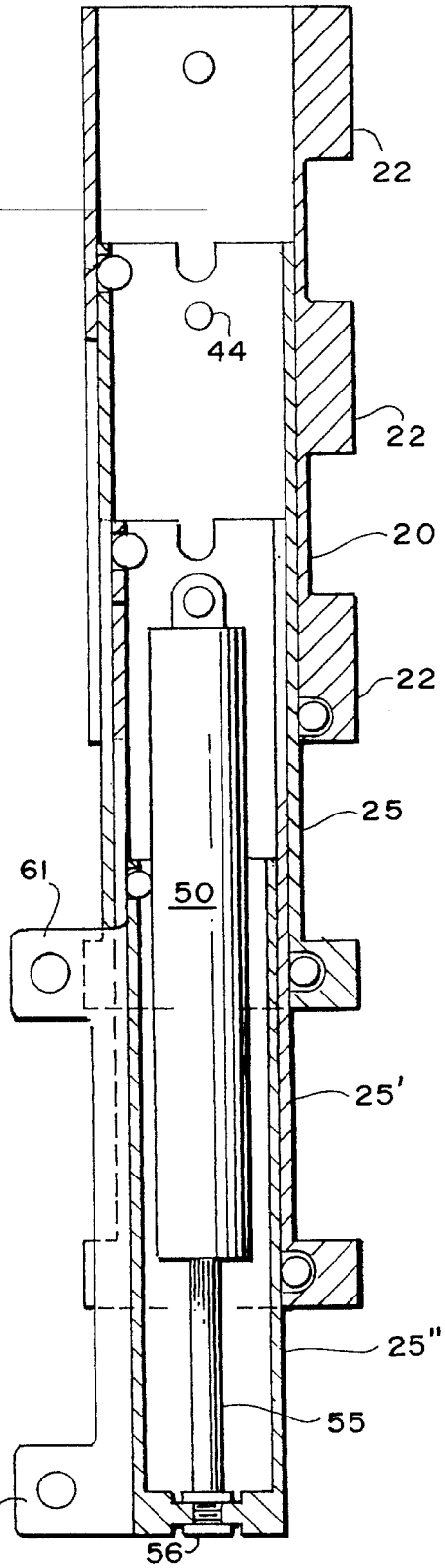
FIG. 6 is a side, cross section view of the preferred embodiment of the present invention in its extended state.

Referring to FIG. 1 of the drawings, the lifting device 10 comprises a pair of support units 11 and 12, respectively. Each support unit is separately attached to the rear portion or transom 14 of boat 15 so that the pair of units, 11 and 12, support a dinghy (not shown) which is positioned transversely to the boat 15.

The support units are of identical construction. Each unit comprises a plurality of hollow vertical support members 20 which have a front vertical slot 21 and which is attached to the transom 14 by brackets 22. Each vertical support member 20 also comprises a side vertical slot 24 to accommodate transverse pins affixing cylinders to drive the vertical extension members as further described below.

Vertically movable support member 20 comprises at least one vertical extension 25. In the preferred embodiment shown in FIGS. 3–6, inclusive, three vertical extensions 25, 25' and 25" are shown. Thus, a total of four extensions are shown as the preferred embodiment counting the three vertical extensions 25, 25' and 25", and the one vertical support member 20 for each support unit 11 and 12, respectively. Furthermore, the vertical extensions are telescoping such that extension 25" can telescope into and out of extension 25'; extension 25' can telescope into and out of extension 25; and extension 25 can telescope into and out of vertical support member 20.

The vertical support unit 20 and vertical extension members 25, 25' and 25" are connected by a series of hydraulic cylinders. Cylinder 30 has a top section 31 and a bottom section 32. The top section 31 of cylinder 30 has a mounting hole therethough for external mounting of a transverse pin 34 to vertical support unit 20. This cylinder 30 may be bolted to the external housing of the vertical support member 20 by a bracket or may be welded thereon. The bottom section 32 of cylinder 30 comprises a threaded piston rod 35 which is secured to bracket 36 located on the bottom of vertical extension 25 by nuts 38.

Similarly, cylinder 40 has a top section 41 and a bottom section 42. The top section 41 of cylinder 40 has a mounting hole therethough for external mounting of a transverse pin 44, through bracket 43 which is secured to the top section 41, to vertical extension 25. Bracket 43 is secured at its bottom to vertical extension 25 by means of screws 47. Transverse pin 44 goes through holes bored through vertical extension 25 to hold cylinder 40 in place in the external relation to vertical extension 25. When the movable extensions are engaged, the pin 44 travels within side vertical slot 24 of vertical support member 20. The bottom section 42 of cylinder 40 comprises a threaded piston rod 45 which is secured to bracket 46 located on the bottom of vertical extension 25' by nuts 48.

A third cylinder 50 having a top section 51 and a bottom section 52 is secured within the interior of vertical extension 25' by a transverse pin mounted through a hole mount on the top section 51 and through aligned holes of vertical extension 25'. The bottom section 52 of cylinder 50 comprises a threaded piston rod 55 which is secured to the holed bottom of vertical extension 25" by nut 56.

Extending horizontally from the final vertical extension 25" through the front slots of the vertical support member 20 and the vertical extension member 25" is a support member 60 pivotable on anchor 61. Support member 60 has a transverse cradle 70 (shown in broken lines) and is held firmly in place by angular support 71 which terminates on final extension member 25".

Figure 7:
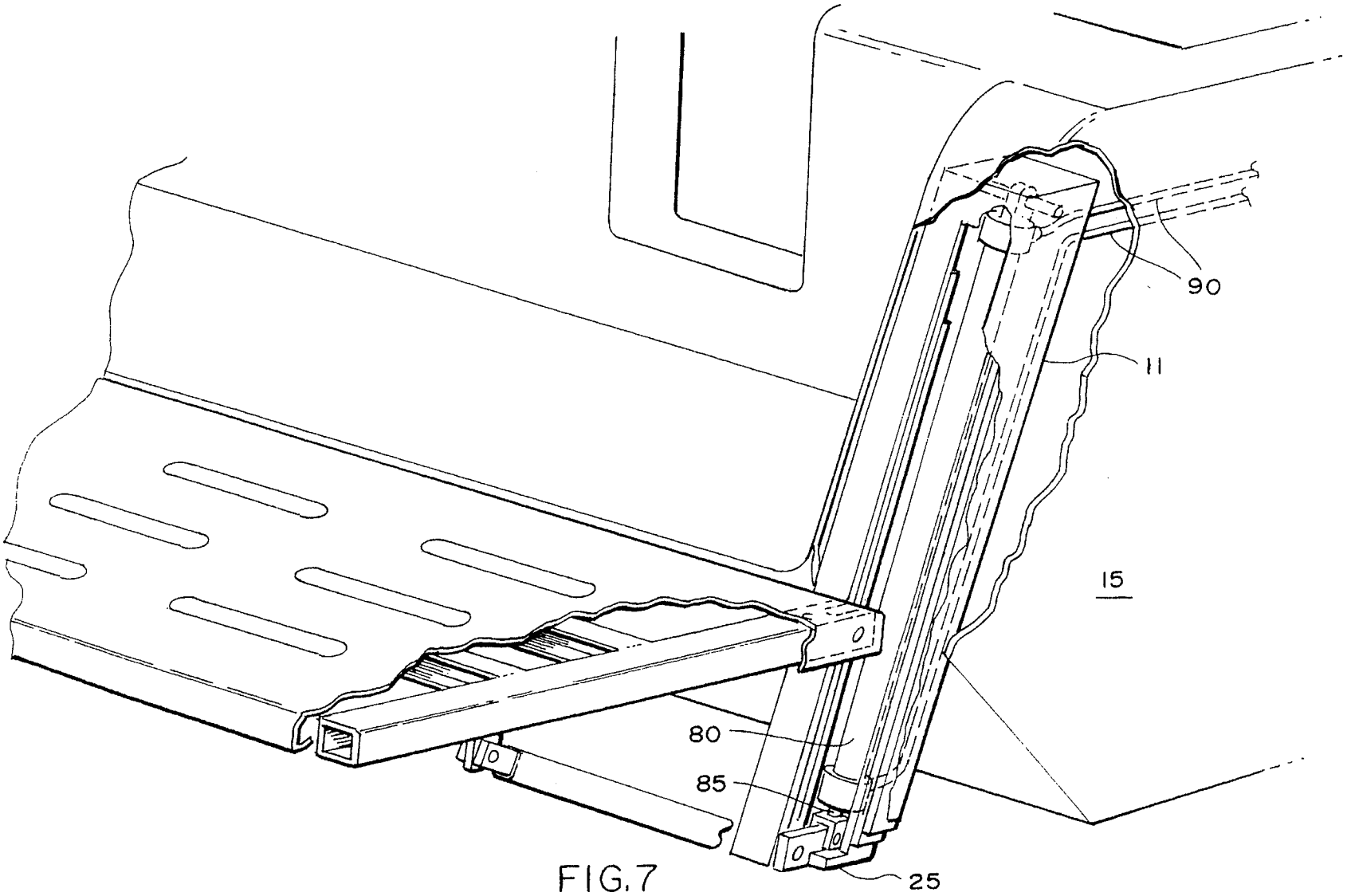
FIG. 7 is a perspectie, partial broken view of an alternative embodiment of the present invention.

While the preferred embodiment shows a plurality of extension members and cylinders, the invention may also be practiced where the support unit 11 (or 12) has but one internal cylinder 80 attached to a final extension 25". (See FIG. 7). This alternative embodiment is dependent upon the length of support unit 11 (or 12), respective extension members, and the ultimate driving length of the piston rod 85 of cylinder 80.

With the invention in the preferred embodiment or in the alternative embodiment, the cylinder(s) drive(s) the vertical extensions which bear the load of the dinghy, etc. Hydraulic fluid lines 90 (shown in broken lines) supply fluid to the cylinders through a conventional drive motor (not shown).

It is intended that the description of the preferred embodiments of this invention is illustrative only. Other embodiments of the invention that are within the scope and concept of this invention are herein included within this application.

What is claimed is:

1. A lifting device for boats, comprising, in combination, a plurality of support units, each said support unit comprising:

a hollow vertical support member having a front vertical slot and a side vertical slot;

means for attaching said hollow vertical support member to another surface;

a plurality of vertical extension members movable up and down within said hollow vertical support unit;

a plurality of hydraulic cylinders attached to and connecting said extension members;

power means for driving said cylinders; and horizontal boat support means connected to said extension members through said front slot;

said plurality of vertical extension members comprising a hollow first member having a vertical front slot and movable by a first cylinder within said hollow vertical support member, a second member movable within said first member by a second cylinder; said horizontal boat support means being anchored to said second member and driven by a third cylinder, said device being characterized in that actuation of said power means selectively and rigidly raises or lowers a boat position on said support means.

2. In the lifting device of claim 1, said first cylinder is external to the hollow vertical support member, said second cylinder is external to said first member and said third cylinder is internal to said second member.

3. In the lifting device of claim 1, said power means being connected to said cylinders by hydraulic fluid lines.

4. A lifting device for boats, comprising, in combination, a plurality of support units, each said support unit comprising:

a hollow vertical support member having a front vertical slot;

means for attaching said hollow vertical support member to another surface;

a plurality of vertical extension members movable up and down within said hollow vertical support unit;

at least one hydraulic cylinder attached to and connecting said extension members;

power means for driving said cylinder; and horizontal boat support means connected to said extension members through said front slot;

said plurality of vertical extension members comprising a hollow first member having a vertical front slot and movable by said cylinder within said hollow vertical support member, a second member movable within said first member; said horizontal boat support means being anchored to said second member and driven by said cylinder, said device being characterized in that actuation of said power means selectively and rigidly raises or lowers a boat position on said support means.

5. In the lifting device of claim 4, said cylinder is internal to the hollow vertical support member, and said first and second members.

* * * * *